US008955677B2

(12) United States Patent
Ladler-Dennis

(10) Patent No.: US 8,955,677 B2
(45) Date of Patent: Feb. 17, 2015

(54) COLLAPSIBLE GIFT CONTAINER

(71) Applicant: Shirley Ann Ladler-Dennis, Vallejo, CA (US)

(72) Inventor: Shirley Ann Ladler-Dennis, Vallejo, CA (US)

( * ) Notice: Subject to any disclaimer, the term of this patent is extended or adjusted under 35 U.S.C. 154(b) by 0 days.

(21) Appl. No.: 13/791,706

(22) Filed: Mar. 8, 2013

(65) Prior Publication Data

US 2013/0186784 A1 Jul. 25, 2013

Related U.S. Application Data

(63) Continuation-in-part of application No. 13/527,530, filed on Jun. 19, 2012, now abandoned, and a continuation-in-part of application No. 13/549,353, filed on Jul. 13, 2012, now abandoned.

(60) Provisional application No. 61/589,359, filed on Jan. 22, 2012.

(51) Int. Cl.
*B65D 85/00* (2006.01)
*B65D 5/42* (2006.01)
*B65D 5/50* (2006.01)

(52) U.S. Cl.
CPC *B65D 85/00* (2013.01); *B65D 5/42* (2013.01); *B65D 5/4229* (2013.01); *B65D 5/5004* (2013.01); *Y10S 206/831* (2013.01)
USPC ..... 206/232; 206/831; 206/459.5; 206/45.29; 229/116.1

(58) Field of Classification Search
USPC ..... 206/232, 831, 459.5, 45.29, 767, 45.28, 206/738, 768; 229/116.1, 126
See application file for complete search history.

(56) References Cited

U.S. PATENT DOCUMENTS

| | | | | | |
|---|---|---|---|---|---|
| 4,108,350 | A * | 8/1978 | Forbes, Jr. | 229/132 |
| 4,865,187 | A * | 9/1989 | Zulauf et al. | 206/772 |
| 5,505,371 | A * | 4/1996 | O'Neill | 229/120.26 |
| 5,996,887 | A * | 12/1999 | Cai et al. | 229/400 |
| 6,158,579 | A * | 12/2000 | Rosenbaum | 206/45.29 |
| 6,371,366 | B1 | 4/2002 | Edgerton et al. | |
| 6,523,692 | B2 * | 2/2003 | Gregory | 206/746 |
| 6,786,331 | B1 * | 9/2004 | Zucchini | 206/232 |
| 6,948,617 | B2 * | 9/2005 | Kanter et al. | 206/504 |
| 7,080,736 | B2 * | 7/2006 | Jackson et al. | 206/738 |
| 8,763,888 | B2 * | 7/2014 | Willman et al. | 229/117 |
| 2002/0088855 | A1 * | 7/2002 | Hodes | 235/385 |
| 2006/0060643 | A1 * | 3/2006 | Sheffer | 229/242 |
| 2006/0185991 | A1 | 8/2006 | Abercia et al. | |
| 2007/0257093 | A1 | 11/2007 | Lott | |
| 2010/0087304 | A1 * | 4/2010 | Little | 493/89 |

* cited by examiner

*Primary Examiner* — Andrew Perreault
(74) *Attorney, Agent, or Firm* — Brian Beverly; Beeson Skinner Beverly, LLP

(57) ABSTRACT

A collapsible gift container comprises hingedly connected front, rear and side walls and a bottom closure having depending front, rear and side panels hingedly connected to the container walls, the front panel overlapping the rear and side panels and extending substantially the full length of the container between its front and rear walls, a note card detachably attached to the side border of a cutout in the front wall of the container, and a reversing tilted product receiving platform extending from the front panel having detachable portions forming one or more product receiving openings, the container foldable between a flat folded configuration and an open-top container configuration.

7 Claims, 16 Drawing Sheets

COLLAPSIBLE GIFT CONTAINER

CROSS-REFERENCE TO RELATED APPLICATIONS

This application is a continuation-in-part of U.S. application Ser. No. 13/527,530, filed Jun. 19, 2012, and a continuation-in-part of U.S. application Ser. No. 13/549,353, filed Jul. 13, 2012, both of which are incorporated herein by reference.

BACKGROUND

1. Field of the Invention

This application relates to collapsible gift containers, and in particular to gift containers having a folding bottom closure including interlocking bottom panels such that the container can be manipulated between a flat folded configuration and a formed configuration which unfolds into an open top container for holding products to be presenting as gifts or for displaying products. In one embodiment of the invention, a detachable note card is provided in the front wall of the container.

2. Prior Art

Traditionally, gift containers, such as gift baskets, are comprised of various retail items placed inside a straw basket or plastic container which, in turn, is placed inside a clear plastic bag or wrap. Such containers are heavy and cumbersome and can be too awkward to carry and difficult to transport. They are not customizable since retailers generally select a particular container to coordinate with or match a product or products. Thus, the consumer has no control over the appearance of gift containers or the coordination of a container for carrying and display selected gift products. In addition, prior art gift baskets are not collapsible and items such as a gift card, ribbon or bow typically needed to round out a pleasing gift presentation must be purchased separately.

Typical prior art gift baskets 2 use a bottom closure 4 that consists of four intersecting panels 6 which when folded together form an auto-lock type of closure 8 as shown in FIGS. 1-2D. While this type of auto-lock closure provides an effective container bottom and permits the container to be folded between a folded flat configuration and a formed container configuration, the amount of weight which the closure can hold is limited. If too much weight is placed in the container, especially in the center of the bottom, the closure will be overtaxed causing the intersecting panels to be pushed downward and break apart the closure. Thus, a stronger bottom closure for gift containers is needed.

SUMMARY OF THE INVENTION

An improved collapsible gift container is comprised of a single, box-like tray that, unlike typical baskets made of straw or other stiff material, is made of sturdy paperboard which folds compactly and collapses into a single unit which can be opened into a container configuration when desired. The container has front, rear and side walls and a bottom closure including four intersecting panels. A cutout created by a custom die cut during manufacture is provided in the center of the container's front wall. A detachable note card is attached to the side borders of the cutout thereby allowing for its easy removal from the front wall. Once removed, this note card serves as a gift card which can be written on and used with container.

The gift container and built-in note card are formed from a single paperboard blank. The blank is formed into a folded flat configuration for compact storage and easy transportation. The invention can be quickly unfolded into an open container configuration, and may be collapsed back to the folded flat configuration if needed.

The collapsible gift container includes a more robust bottom closure than found in the prior art. Instead of the intersecting panels used in a typical auto-lock closure, the topmost panel is extended substantially across the full front-to-back length of the container thereby strengthening the bottom closure. This allows the container to hold heavier products and prevents unwanted failure of the bottom closure. Although the new panel is larger than found in the prior art, it is tucked inside the container walls when the invention is collapsed to its flat folded configuration.

The interior walls of the invention support adhesive strips which hold in place a cellophane bag that may optionally be placed by a consumer after expanding the invention into the open container configuration.

BRIEF DESCRIPTION OF THE ILLUSTRATIONS

Figure 1:
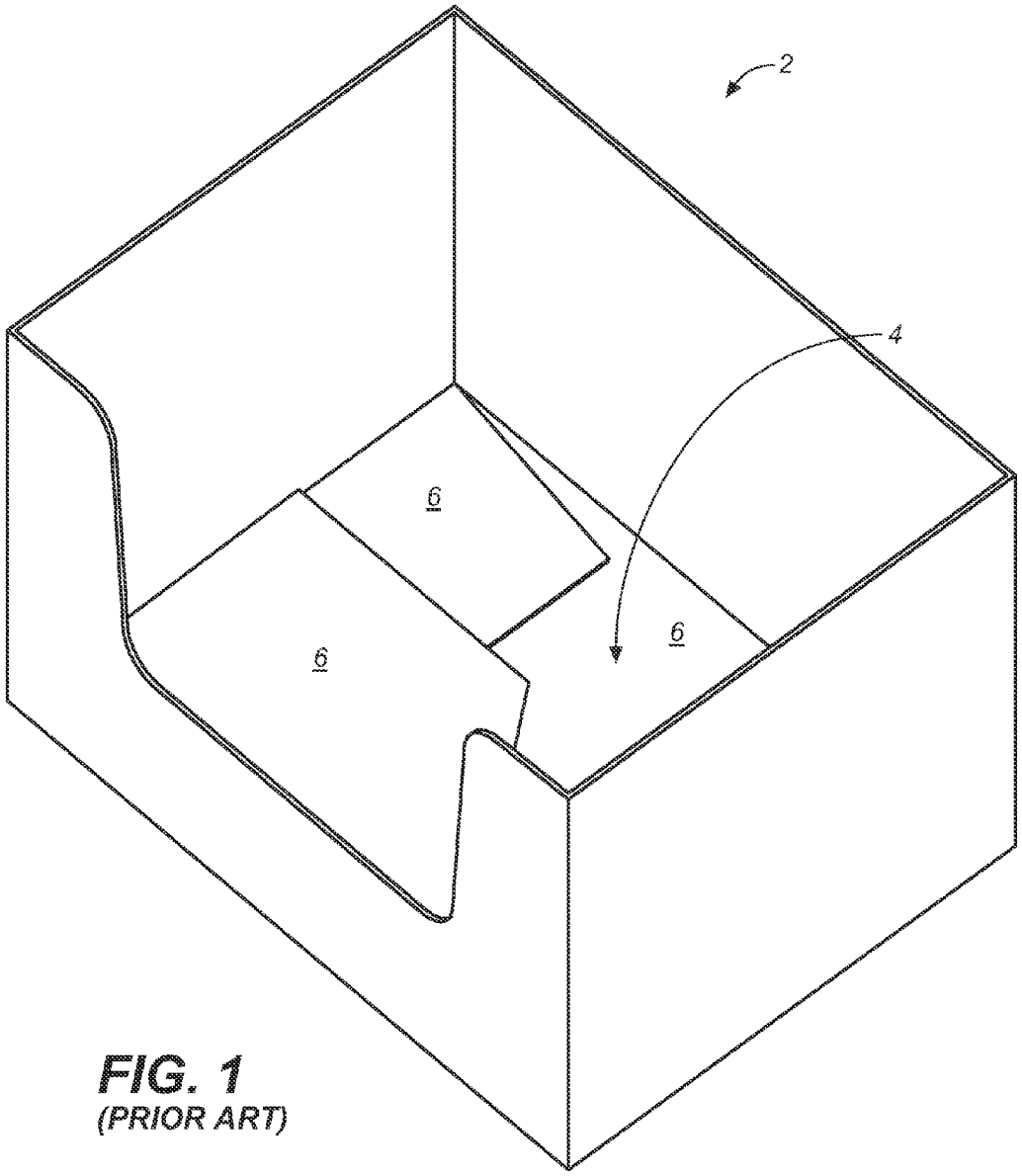
FIG. 1 (PRIOR ART)
FIG. 1 is an upper perspective view of a prior art collapsible gift container.
Figure 2A:
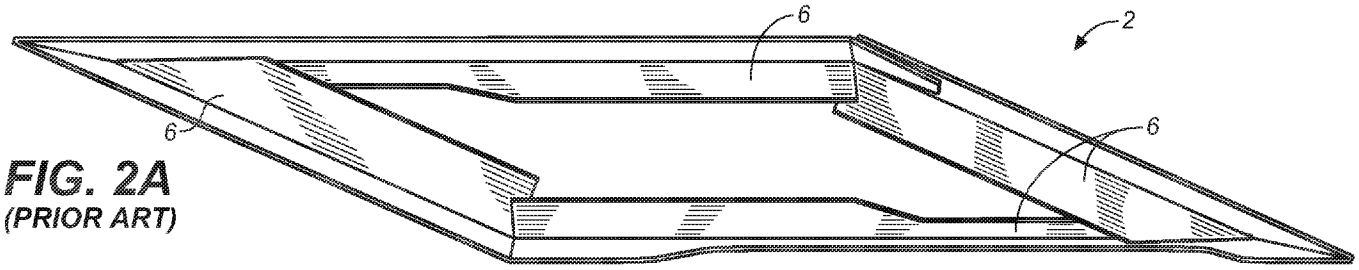
FIG. 2A (PRIOR ART)
FIG. 2A is a top plan view of the collapsible gift container shown in FIG. 1 in a flat folded configuration.
Figure 2B:
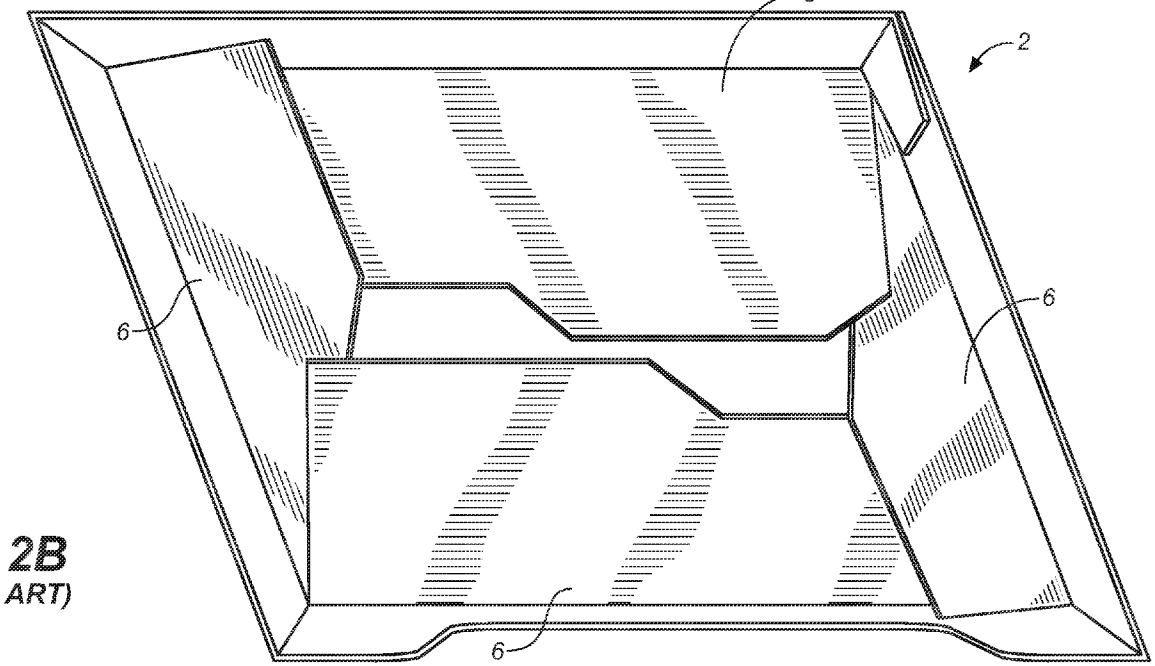
FIG. 2B (PRIOR ART)
FIG. 2B is a top plan view of the collapsible gift container shown in FIG. 1 midway between being formed from the flat folded configuration shown in FIG. 2A to the container configuration shown in FIG. 2C.
Figure 2C:
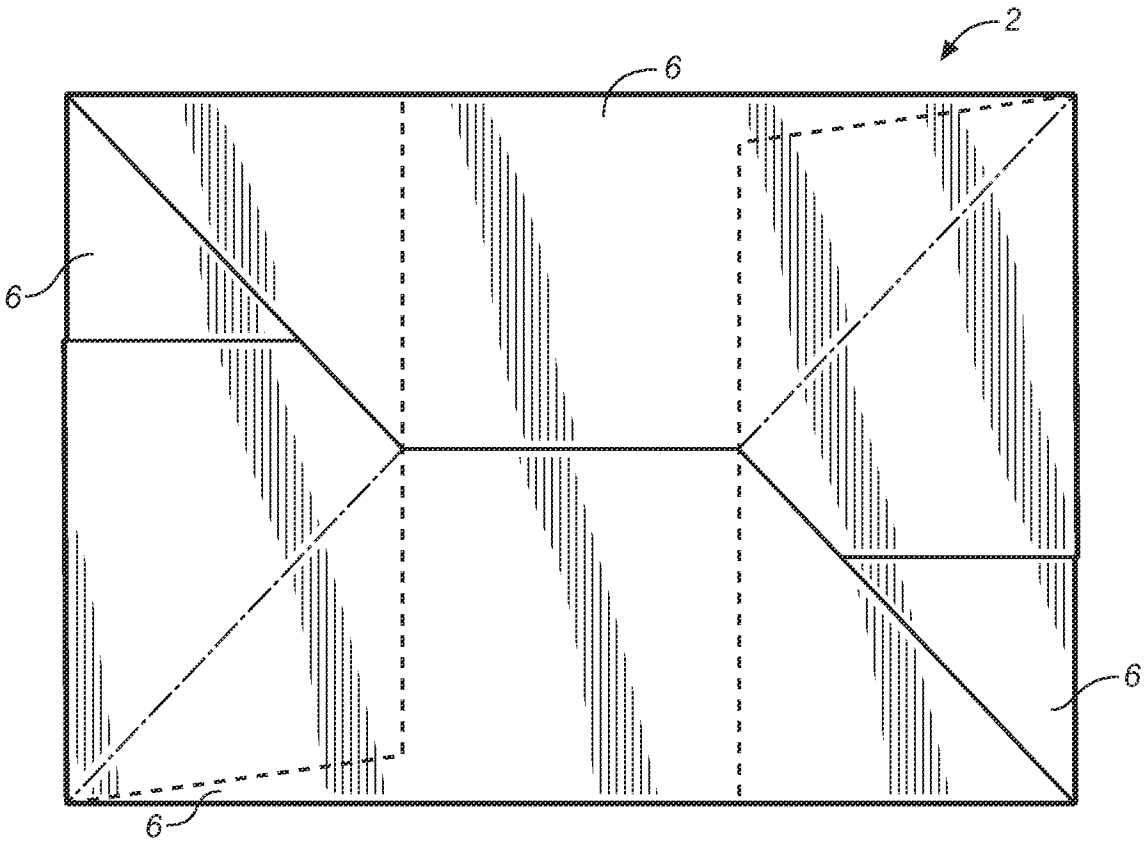
FIG. 2C (PRIOR ART)
FIG. 2C is a bottom plan view of the collapsible gift container shown in FIG. 1 that has been folded into a container configuration.
Figure 2D:
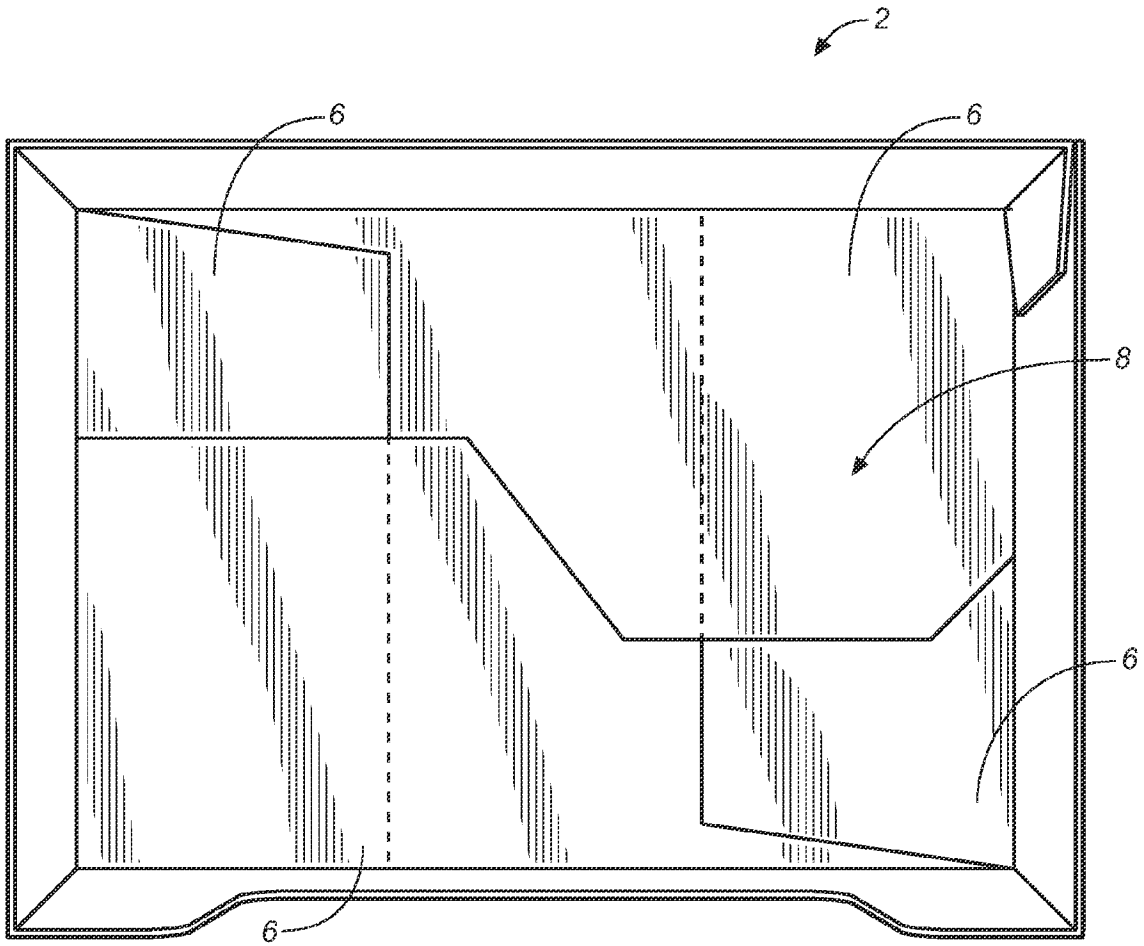
FIG. 2D (PRIOR ART)
FIG. 2D is a top plan view thereof.
Figure 3:
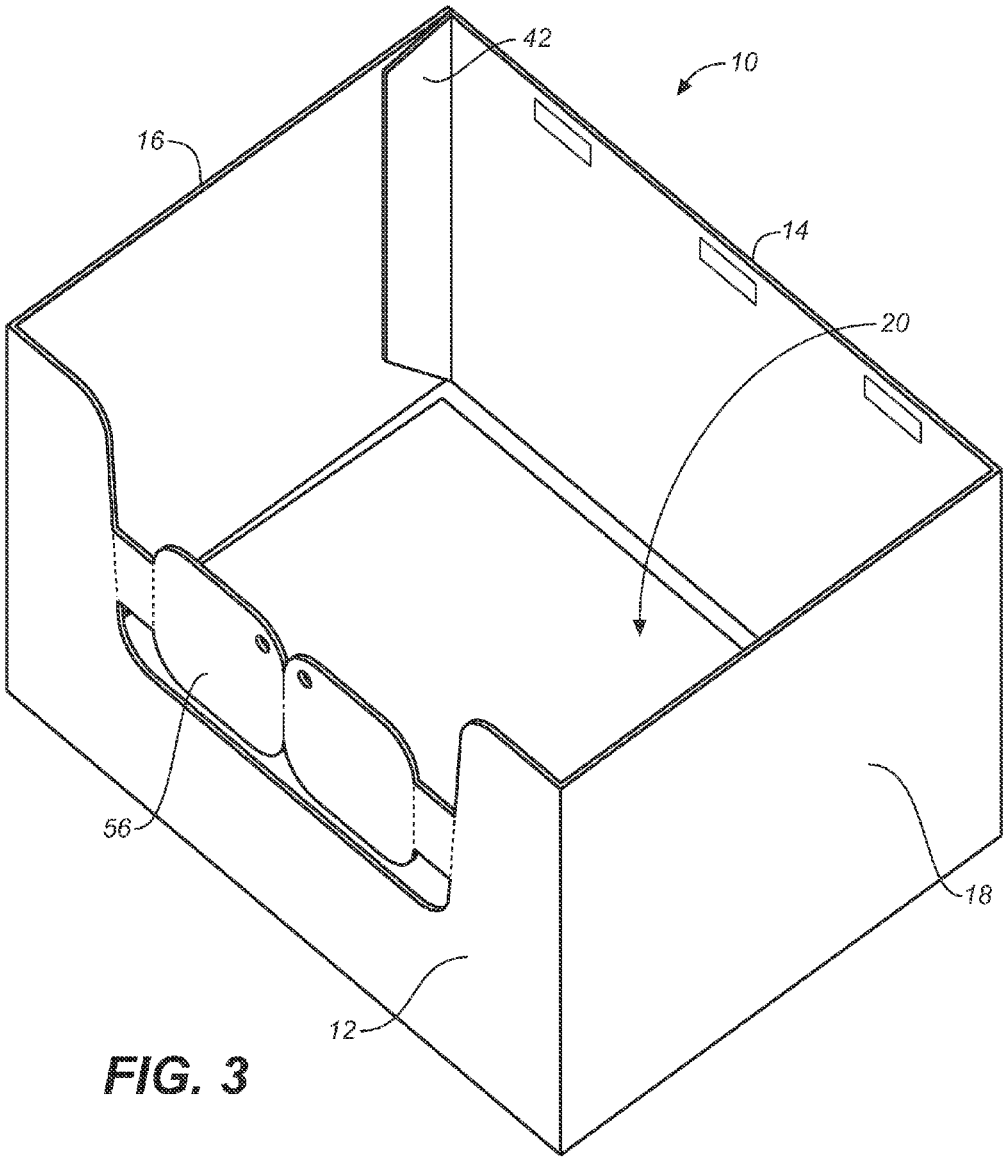
FIG. 3 is an upper perspective view of a collapsible gift container according to the invention.
Figure 4A:
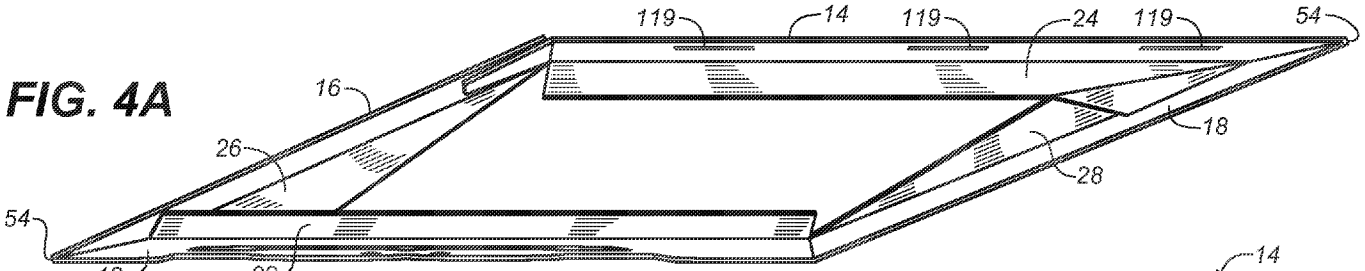
Figure 4B:
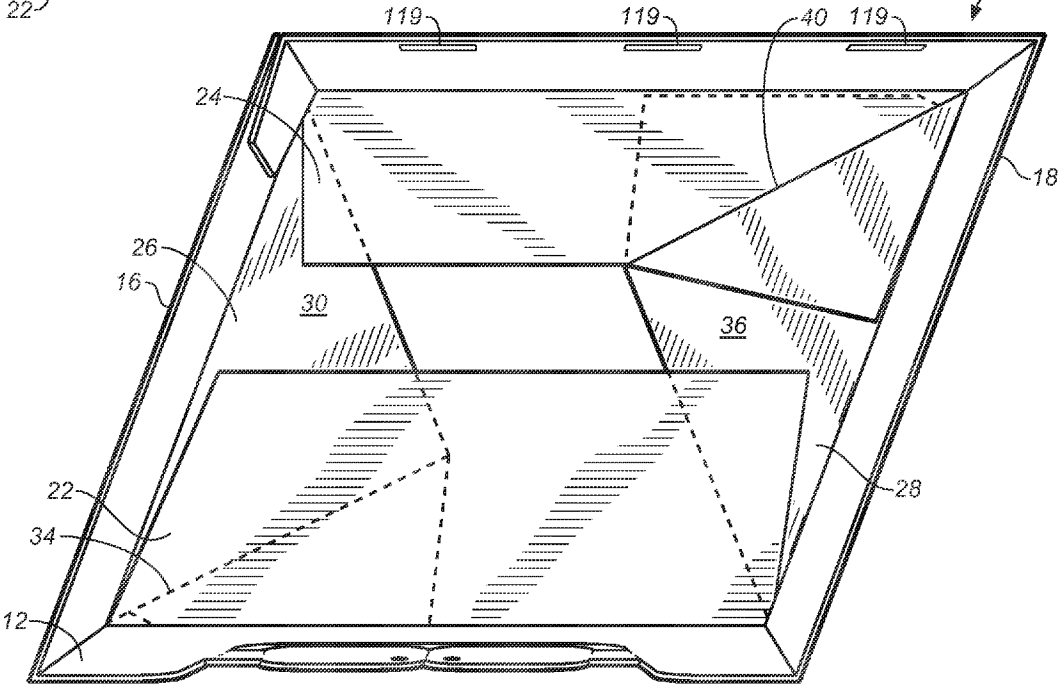
Figure 4C:
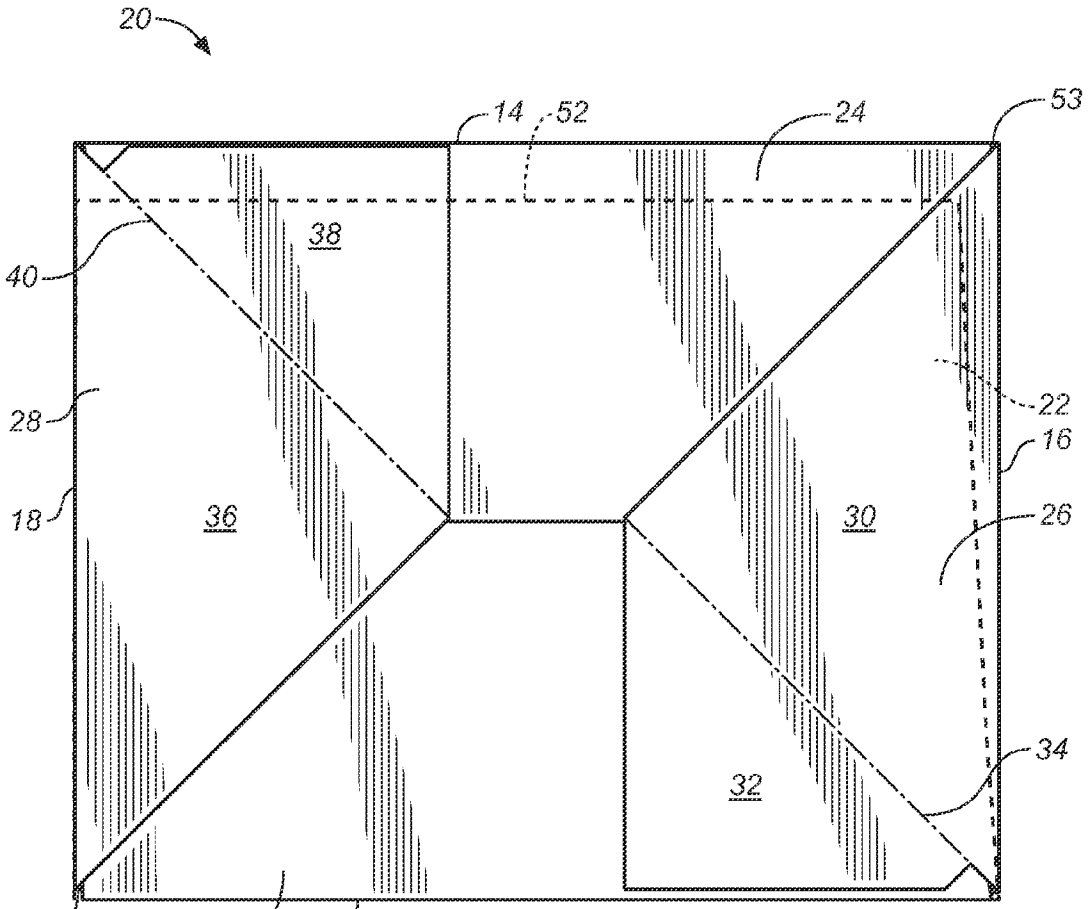
Figure 4D:
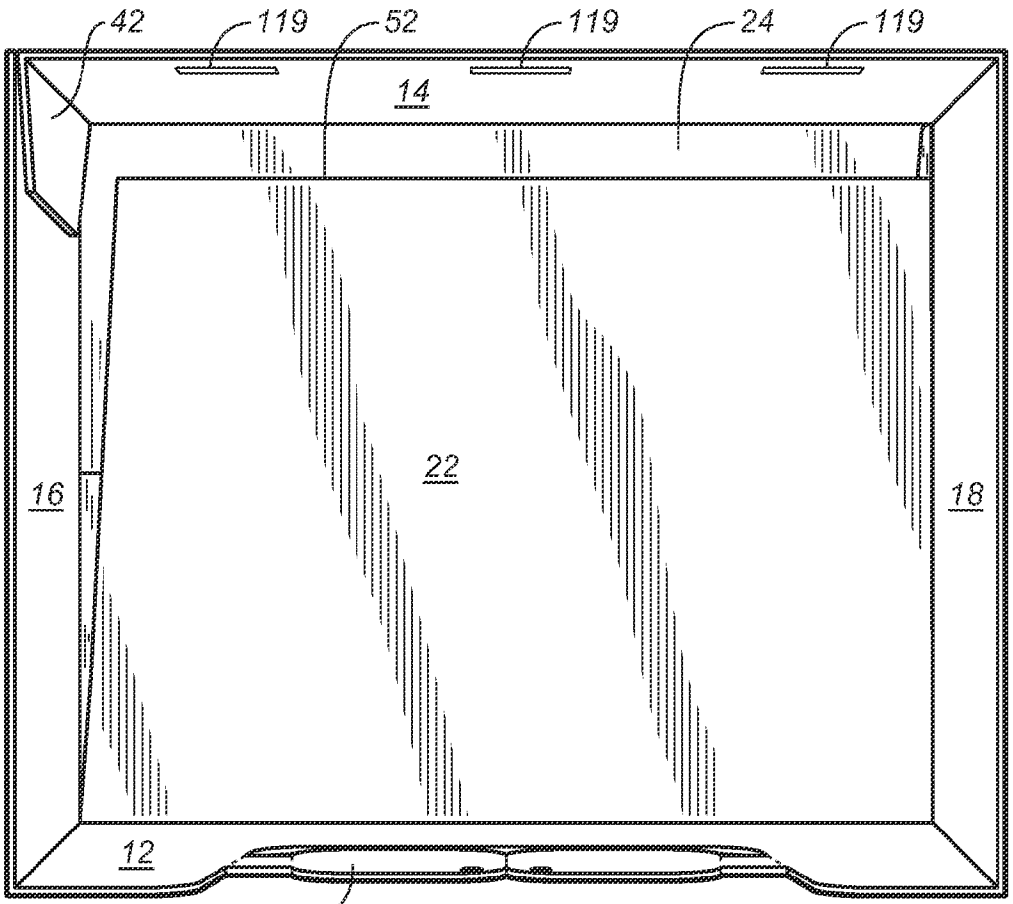
Figure 5:
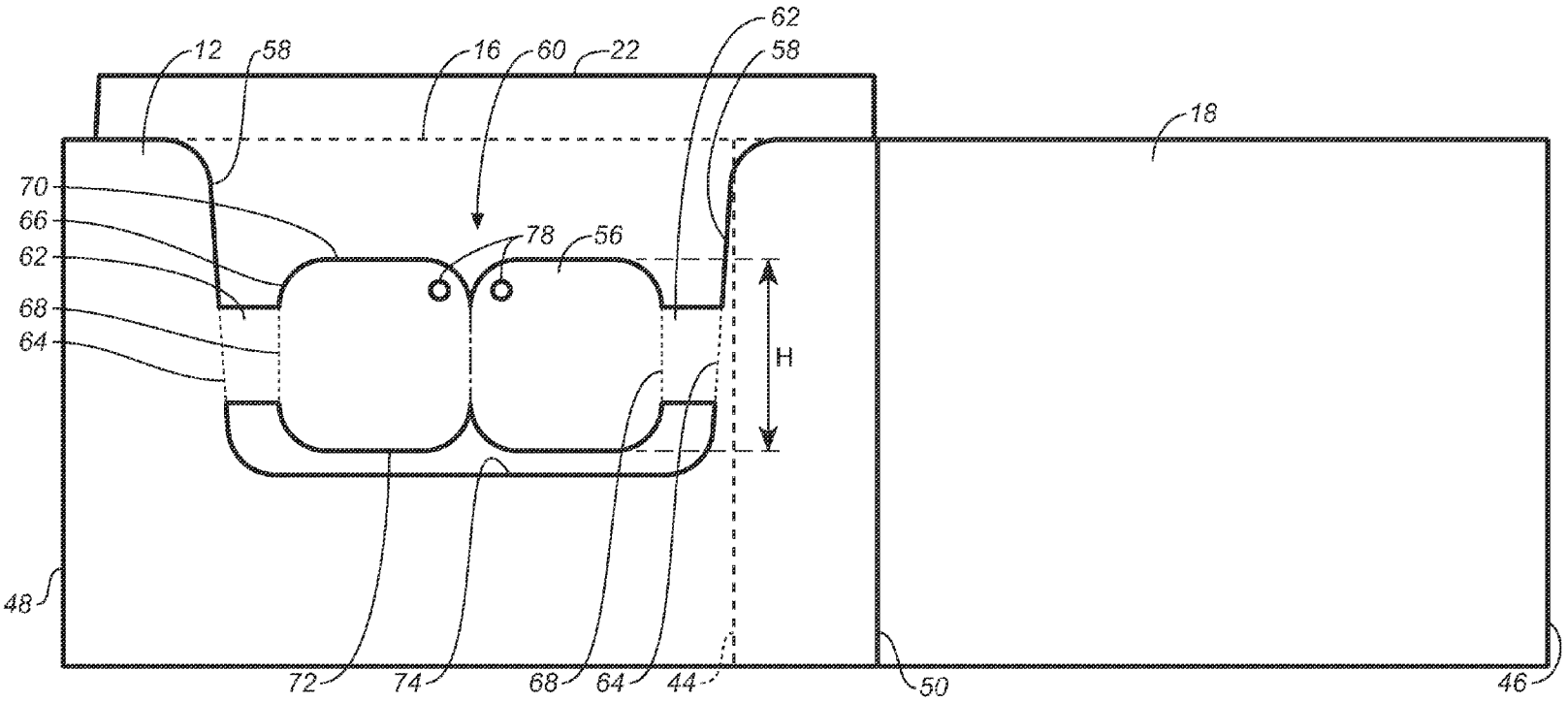
Figure 6:
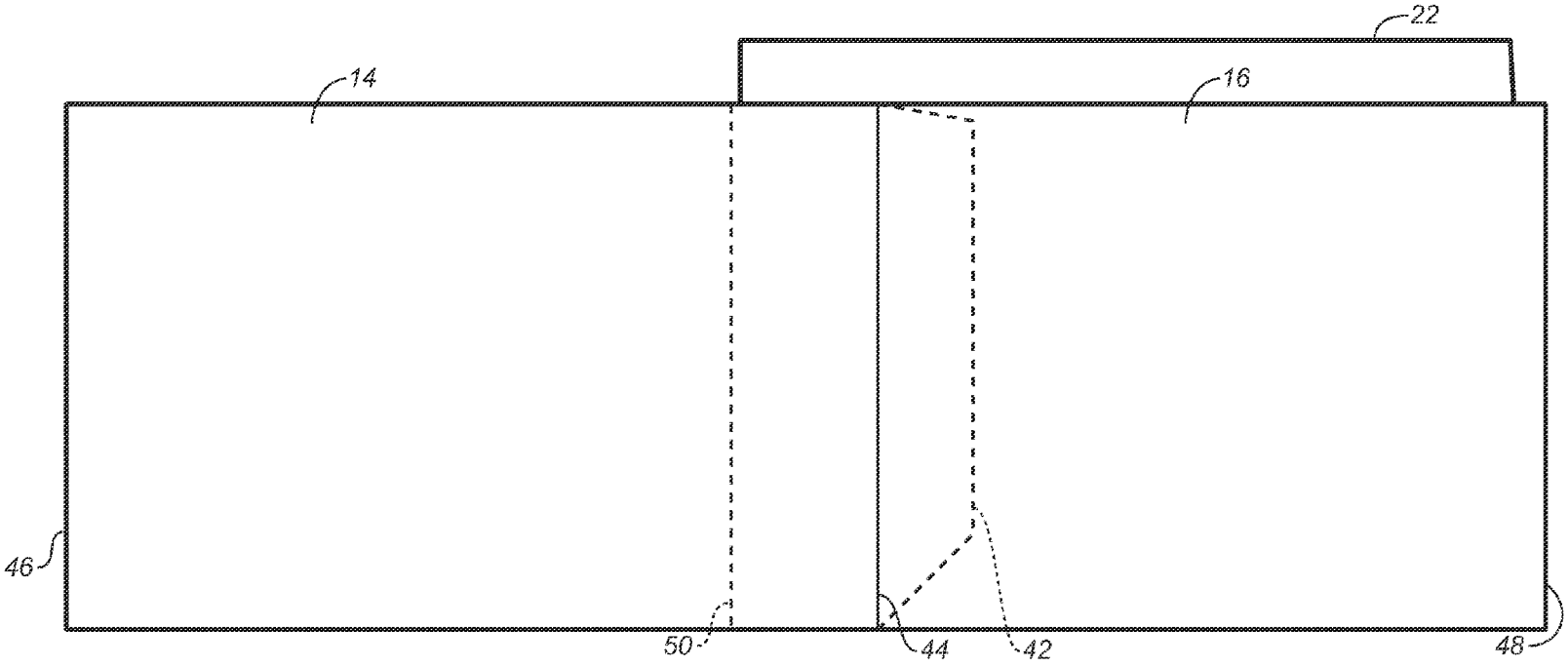
Figure 7:
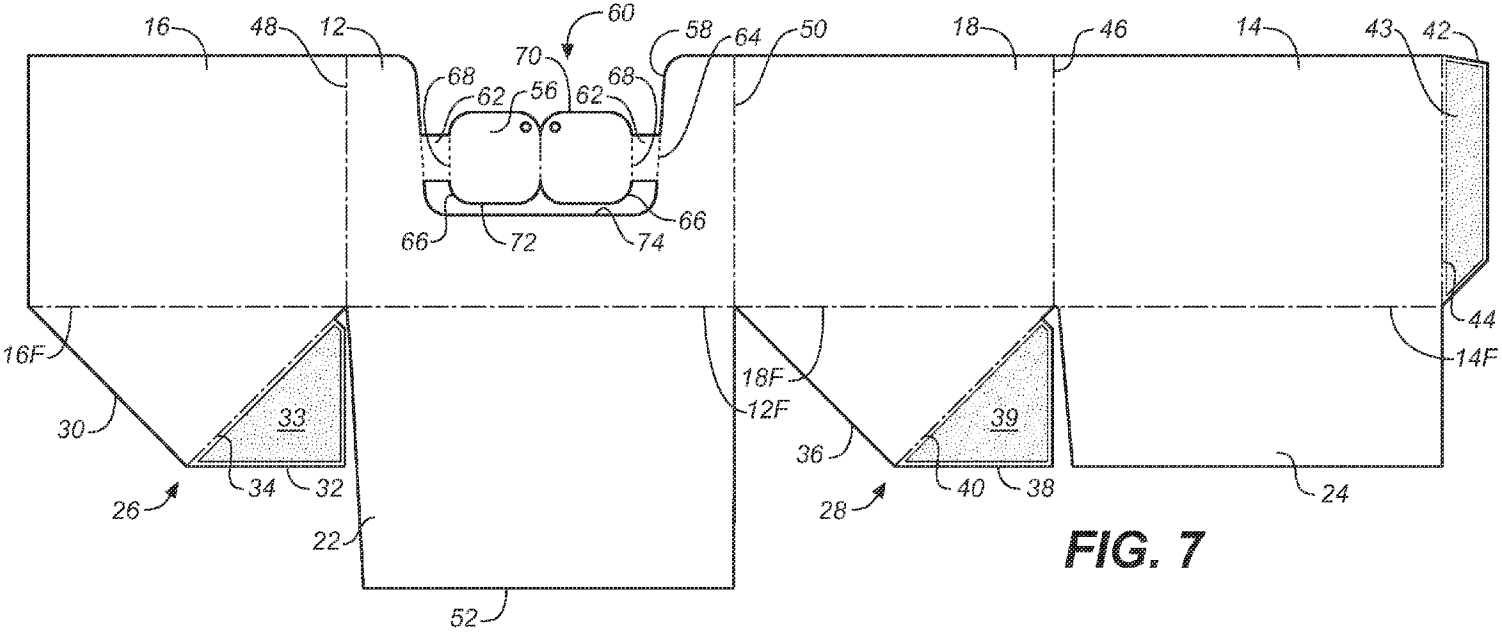

FIG. 4*a* is top plan view of the collapsible gift container shown in FIG. 3 in a flat folded configuration;

FIG. 4B is a top plan view of the collapsible gift container shown in FIG. 3 midway between being formed from the flat folded configuration shown in FIG. 4A to the container configuration shown in FIG. 4C;

FIG. 4C is a bottom plan view of the collapsible gift container shown in FIG. 3 that has been folded into a container configuration;

FIG. 4D is a top plan view of the collapsible gift container shown in FIG. 3 that has been folded into a container configuration;

FIG. 5 is an elevation view of the collapsible gift container shown in FIG. 3 in a flat folded configuration shown the front and one side wall thereof;

FIG. 6 is an elevation view of the collapsible gift container shown in FIG. 3 in a flat folded configuration shown the rear and the other side wall thereof;

FIG. 7 is a plan view of the blank used to form the collapsible gift container shown in FIGS. 3-6.

Figure 8B:
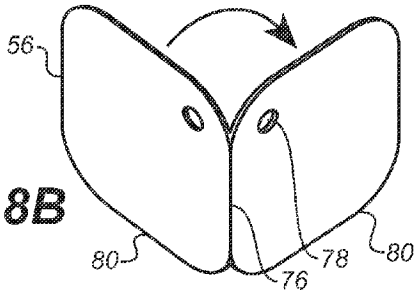
Figure 8A:
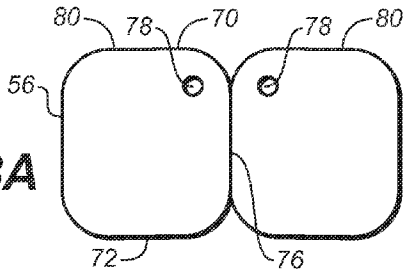
Figure 9B:
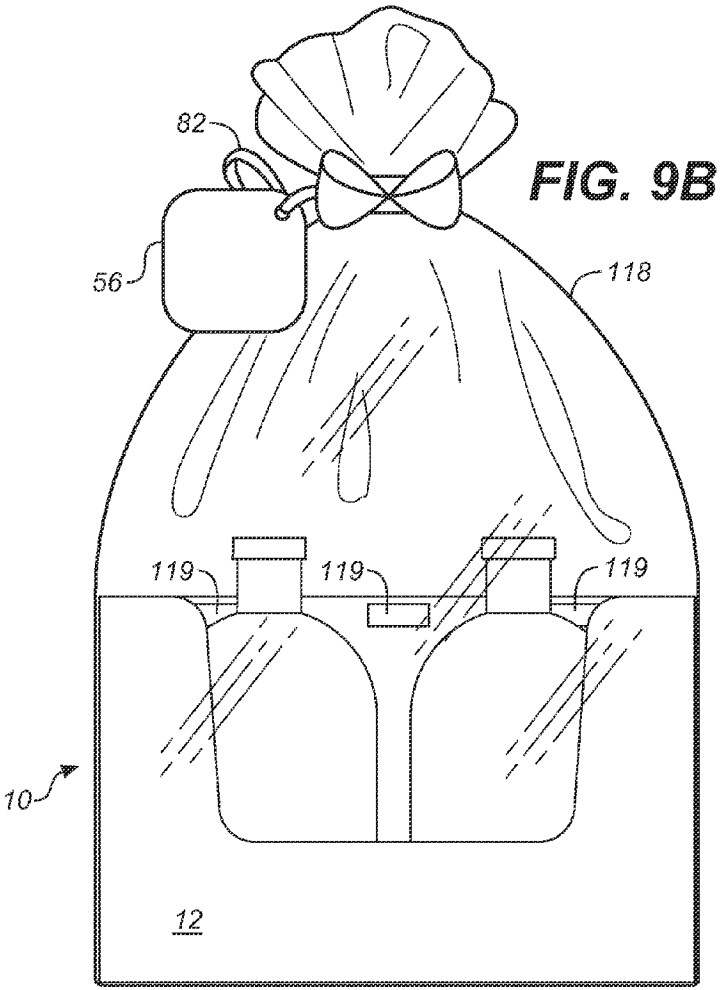
Figure 9A:
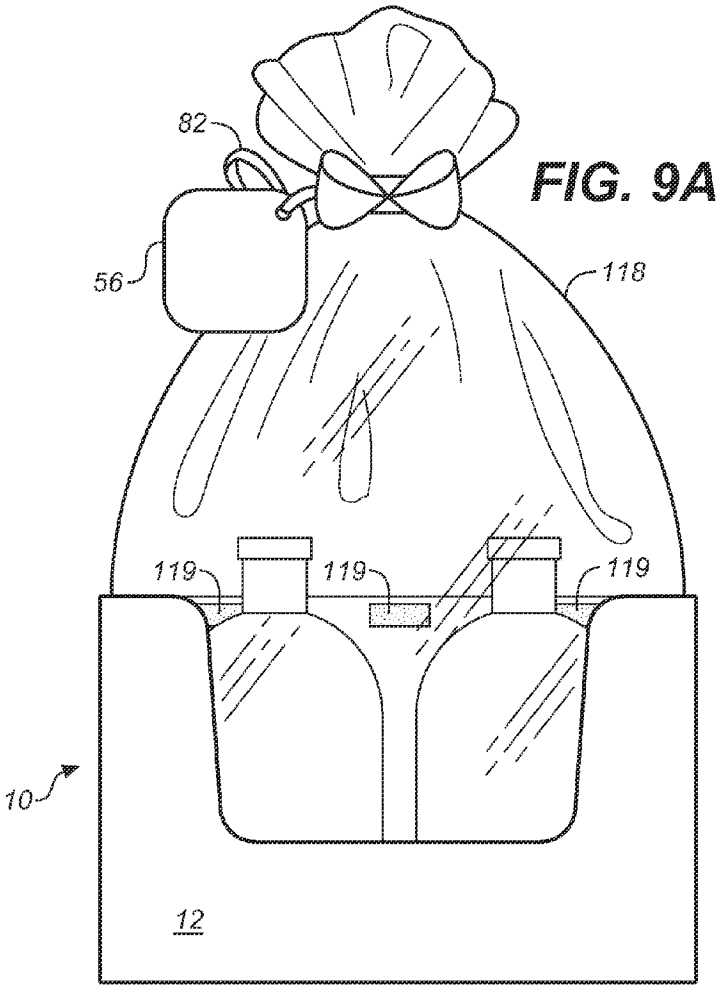
Figure 10A:
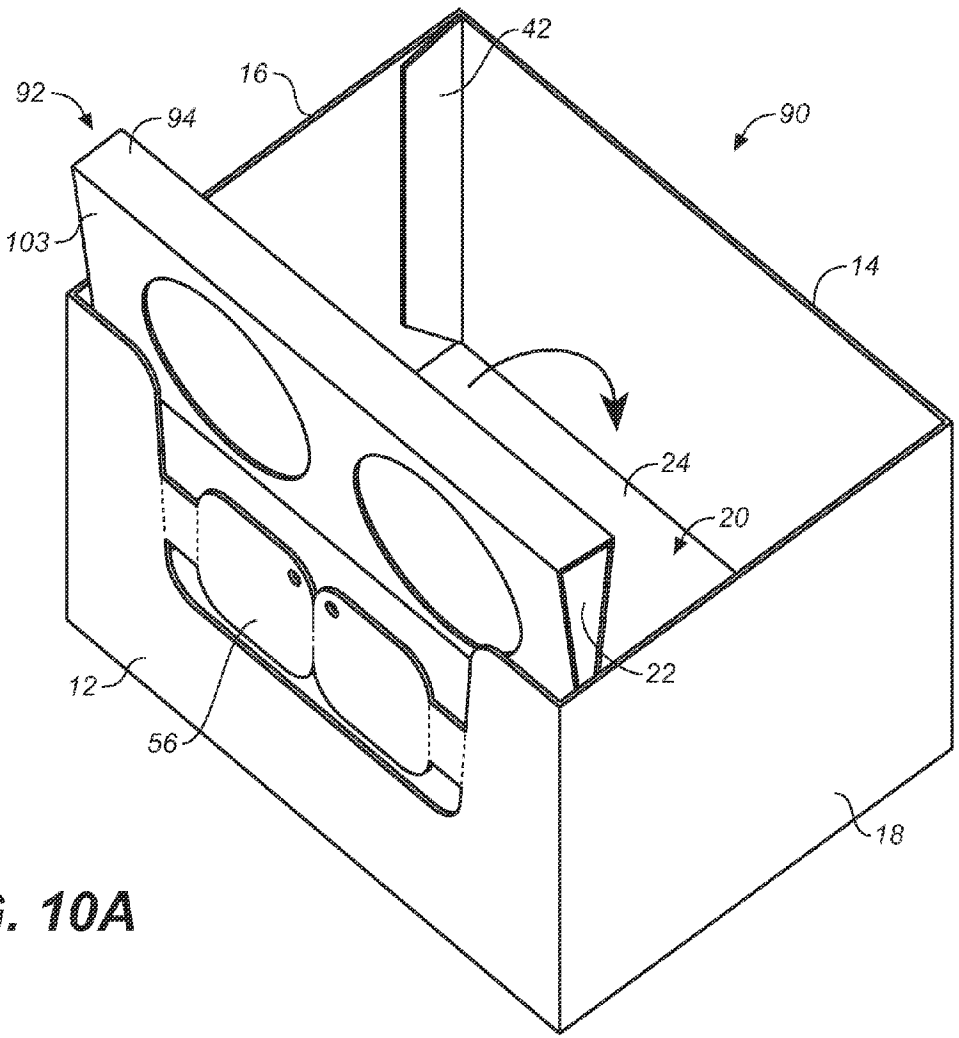
Figure 10B:
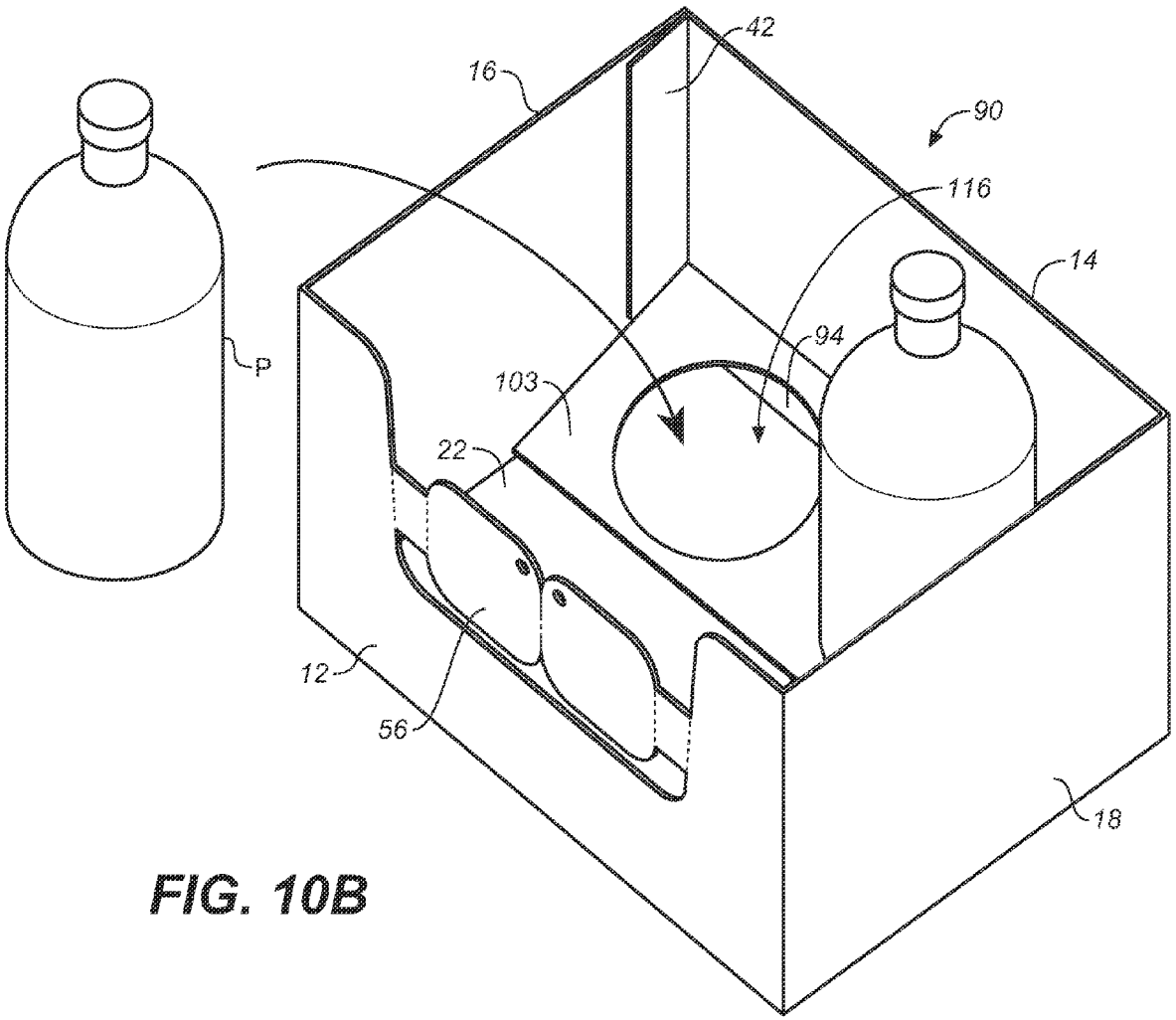
Figure 11:
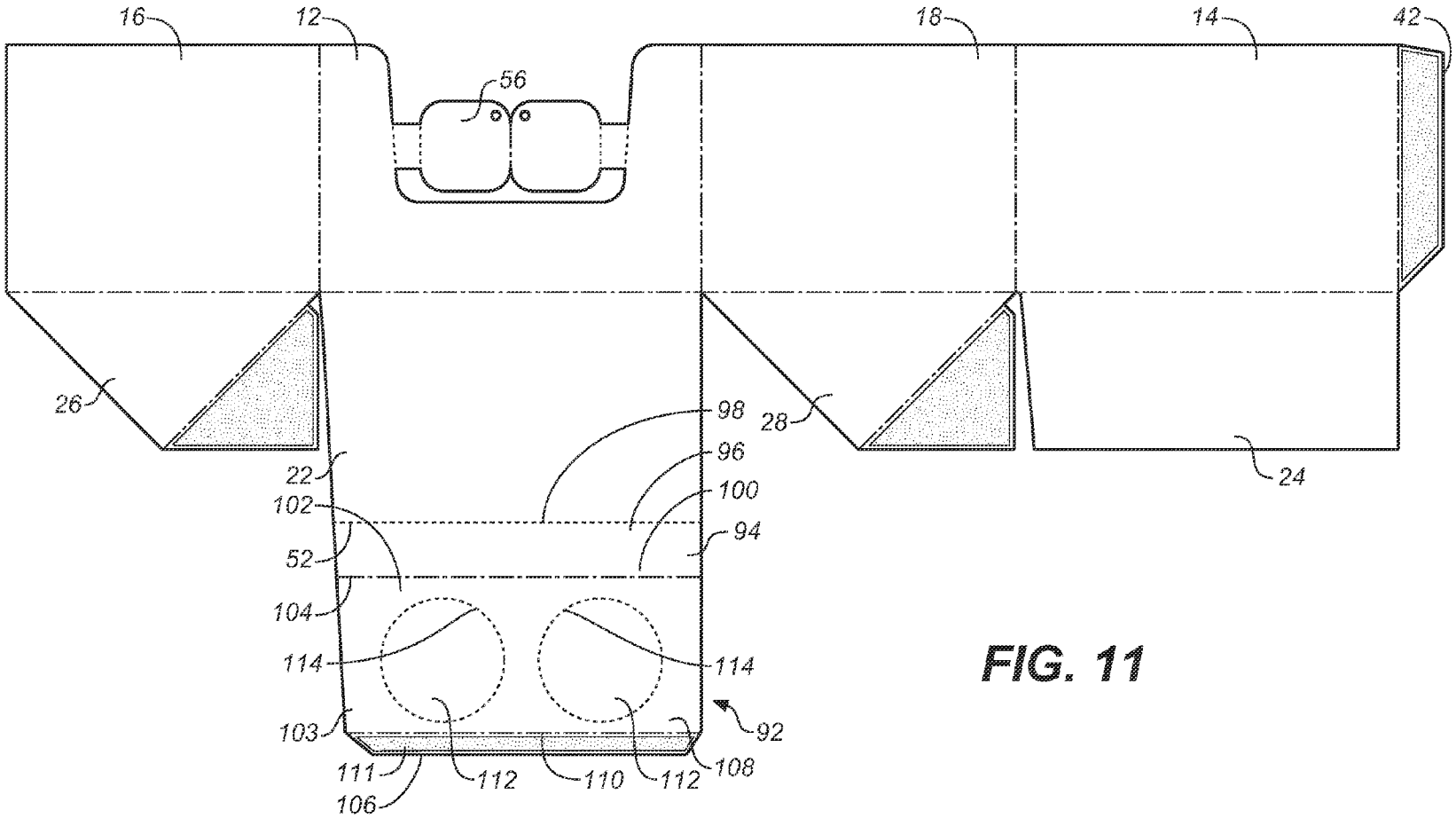
Figure 12:
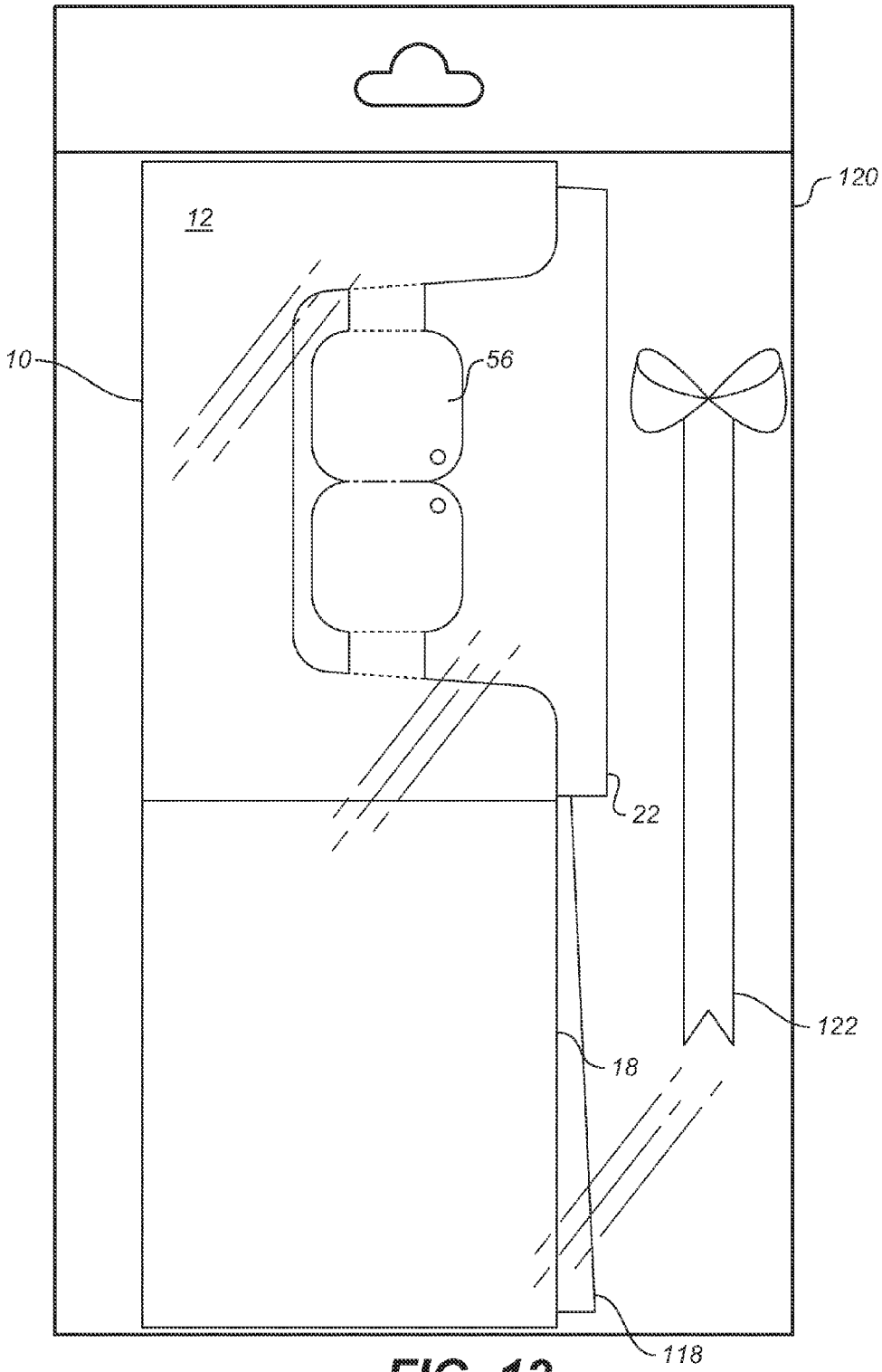

FIG. 8A is a plan view of the detachable note card shown in FIG. 7;

FIG. 8B is an upper perspective view of the note card thereof being folded;

FIG. 9A is an upper perspective view of the collapsible gift container shown in FIG. 3 with a clear bag inserted inside the container walls;

FIG. 9B is an upper perspective view of the collapsible gift container shown in FIG. 3 showing the container inserted inside a clear bag;

FIG. 10A is an upper perspective view of another embodiment of a collapsible gift container having a slope product receiving platform;

FIG. 10B is an upper perspective view thereof showing products being placed in the product receiving platform;

FIG. 11 is a plan view of the blank used to form the collapsible gift container shown in FIGS. 10A and 10B; and FIG. 12 is an elevation view of a collapsible gift container in a clear product presentation bag with a clear presentation bag and a gift ribbon and bow.

DETAILED DESCRIPTION OF THE ILLUSTRATED EMBODIMENT

A collapsible gift container according to the invention, generally referred to at 10 in FIG. 3, comprises a front wall 12, rear wall 14, side walls 16 and 18, and a bottom closure 20 as shown in FIGS. 3 and 4A-4D. The front wall 12 and rear wall 14 are hingedly attached to side walls 16 and 18 such that the four walls can be folded between the folded flat configuration shown in FIG. 4A and the open container configuration shown in FIG. 4C.

The bottom closure 20 comprises front panel 22, rear panel 24, and side panels 26 and 28, which depend from and are hingedly attached to front wall 12, rear wall 14, and side walls 16 and 18, respectively, at fold lines 12F, 14F, 16F, and 18F. See also FIG. 7 discussed below. Side panel 26 includes a primary area 30 and a bonding area 32 hingedly joined to the primary area around fold line 34. Similarly, side panel 28 includes a primary area 36 and a bonding area 38 hingedly joined to the primary area around fold line 40.

FIG. 7 shows a blank used to construct the invention as shown in FIGS. 3-4D. This is accomplished by affixing wall attachment flap 42, having adhesive area 43, to side wall 16 which hingedly joins rear wall 14 to side wall 16 about fold line 44. The four walls of the container are thus joined together in a foldable structure with rear wall 14 also hingedly joined to side wall 18 about fold line 46, and front wall 12 hingedly joined to side walls 16, 18 about fold lines 48, 50.

To complete the construction, front panel 22 is folded perpendicular to front wall 12, rear panel 24 is folded perpendicular to rear wall 14 and in overlapping relation to front panel 22, side panels 26 and 28 are folded perpendicular to side walls 16 and 18 overlapping front and rear panels 22, 24, and bonding areas 32, 38 are affixed using adhesives 33, 39 to front and rear panels 22, 24, respectively, as best shown in FIG. 4C. FIG. 4D shows that, in the open container configuration, front panel 22 extends from front wall 12 substantially the entire length of the container so that the distal end 52 thereof is closely adjacent to rear wall 14. As can be appreciated with additional reference to FIG. 4C, the greater length of front panel 22 causes it to completely overlay rear panel 24 and side panels 26, 28 thereby strengthening the bottom closure relative to the prior art closure discussed above.

FIG. 5 shows front wall 12 and side wall 18 of the container 10 in the flat folded configuration shown in FIG. 4A. Similarly, FIG. 6 shows rear wall 14 and side wall 16 of the container 10 in the flat folded configuration. It is seen that in the illustrated embodiment front panel 22 is sandwiched between front wall 12 and rear wall 14 such that the flat folded configuration of the invention presents in a pleasing generally rectangular format.

With reference again to FIGS. 4A-4C, it can been seen that, by pressing inwardly on opposite corners 53, the container can be folded from the container configuration shown in FIG. 4C to the flat folded configuration shown in FIG. 4A. FIG. 4B shows the panels 22, 24, 26, 28 of the bottom closure folded inwardly between the walls 12, 14, 16, 18 of the container 10 midway between the container and folded flat configurations. Similarly, by pressing inwardly on opposite corners 54, the container may be manipulated from the flat folded configuration shown in FIG. 4A to the open container configuration shown in FIG. 4C.

A note card 56 is detachably attached to the vertically extending side borders 58 of a cutout area 60 in the front wall 12 of the container. In the illustrated embodiment, note card 56 is attached to side borders 58 via two joining strips 62. Each joining strip 62 is detachably attached to the front wall 12 of the container at an outer tear line 64 extending along one of the side borders 58 a distance substantially less than half the height thereof, and is detachably attached to one of the side edges 66 of note card 56 at an inner tear line 68 extending along the side edge 66 a distance substantially less than the height H of note card 56. In the illustrated embodiment, the inner and outer tear lines each comprise lines of perforations, but those of skill in the art will understand that the tear lines could also comprise score lines or other known ways of weakening the material in order to facilitate tearing along a line. The top and bottom edges 70, 72 and the top and bottom parts of the side edges 66 of note card 56 are die cut giving them a clean, sharp edge. The bottom edge 72 is spaced above the bottom border 74 of the cutout area 60. Thus, the joining strips 62 are attached to a limited portion of the side edges 66 of note card 56 to facilitate removal of the card from the front wall 12 of the container, and to minimize the connection to the note card 56 so that when the note card 56 is detached from front wall 12 the side edges 66 will be as smooth as possible.

As seen in FIGS. 8A and 8B, note card 56 can be folded in half about central fold line 76. An aperture 78 is positioned in each half 80 of the card such that when the card is folded in half, the apertures coincide so that a string or cord 82 may be introduced through the apertures for tying the card to the gift container as shown in FIGS. 9A and 9B.

With reference now to FIGS. 10A, 10B and 11, another embodiment 90 of a collapsible gift container is illustrated. Collapsible gift container 90 is similar to the embodiment shown in FIGS. 3-9B, having front, rear and side walls 12, 14, 16, 18, and front, rear, and side panels 22, 24, 26, 28 forming a bottom closure 20. However, a product receiving platform 92 is attached to the front panel 22 for holding products placed within the container as shown in FIGS. 10A and 10B. As shown in FIG. 11, an elevation panel 94 is hingedly attached at a lower edge 96 to front panel 22 at a line of perforations 98, and is hingedly attached at an upper edge 100 to a first edge 102 of sloped product receiving panel 103 about fold line 104. The product receiving platform 92 may thus be optionally detached from the front panel 22 leaving the embodiment discussed above in connection with FIGS. 3-9B.

A securement flap 106 is hingedly attached to a second edge 108 of product receiving panel 103 about fold line 110. As the container 90 is formed into the container configuration as discussed above, the elevation panel 94 is folded upwards relative to front panel 22 thereby elevating its upper edge 100. The product receiving panel 103 is then folded downward toward the front panel 22 and the securement panel 106 is folded under the second edge 108 of the product receiving panel 103 and attached to the front panel 22 using adhesive 111. See FIG. 10B. Since the first edge 102 of product receiving panel 103 is raised by elevation panel 94, product receiving panel 103 assumes a sloped disposition relative to front panel 22 as seen in FIG. 10B.

One or more detachable portions 112 are provided in product receiving panel 103 bounded by a line of perforations 114 such that the portions 112 may be removed from the product receiving panel 103 to create product receiving openings 116 such as shown in FIG. 10B. Product receiving platform 92 thus provides a convenient and secure base for holding products P in the manner shown in FIG. 10B.

In either embodiment, once the gift container 10 or 90 is formed, a cellophane bag 118 may be placed inside the container, as shown in FIG. 9A, or the container may be placed inside the cellophane bag as shown in FIG. 9B. Strips of adhesive 119 having removable covering strips may be provided on the inside or outside upper edges of the walls of the container to assist in securing the cellophane bag in place. Products may then be placed in the gift container, and the cellophane bag may be closed using note card 56 to form an attractive gift container.

FIG. 12 shows product packaging 120 for retail display of a collapsible gift container according to the invention. The package may include the collapsible gift container 10, a ribbon or bow 122, and a cellophane bag 118 (such as that shown in FIGS. 9A and 9B).

A collapsible gift container as described and illustrated herein is highly portable, is easily and quickly formed into an open container configuration from a flat folded configuration, has a built-in note card, can be purchased in a kit form with accompanying ribbon and bow and cellophane bag, and can be manufactured with numerous surface patterns and prints allowing the customer to customize the gift container to a particular occasion or set of gifts.

There have thus been described and illustrated certain preferred embodiments of a collapsible gift container according to the invention. Although the present invention has been described and illustrated in detail, it is clearly understood that the same is by way of illustration and example only and is not to be taken as limiting, the spirit and scope of the present invention being limited only by the terms of the appended claims and their legal equivalents.

I claim:

1. A collapsible gift container comprising:

a front wall, a rear wall, and two side walls hingedly connected to said front and rear walls, said front wall having a cutout area defined by opposing vertical side borders, a bottom closure having a front panel hingedly connected to said front wall, a rear panel hingedly connected to said rear wall, and two side panels hingedly connected to said side walls, each of said side panels having a primary area and a bonding area hingedly attached to said primary area, said front panel affixed to the bonding area of one of said side panels, said rear panel affixed to the bonding area of the other of said side panels, said walls and said bottom closure foldable between a flat folded configuration and an open container configuration, in said flat folded configuration, said front wall and one of said side walls are folded into generally parallel adjacent disposition to said rear wall and the other of said side walls, and said bottom closure is sandwiched between said walls with said front panel adjacent said front wall, said rear panel adjacent said rear wall, one of said side panels disposed between said front wall and one of said side walls, and the other of said side panels disposed between said rear wall and the other of said side walls, and in said container configuration said side walls are folded into perpendicular relation to said front and rear walls such said front and rear walls are spaced apart defining a container length and said side walls are spaced apart defining a container width, and said bottom closure is folded into a flat overlapping arrangement wherein said front and rear panels overlay said side panels, said front panel overlays said rear panel, and said front panel extends across substantially the entire length of said container length and across substantially the entire width of said container width, thereby reinforcing said bottom closure, such that said walls and said bottom closure form an open-top container, a note card having opposite top and bottom edges and oppositely facing side edges, said top and bottom edges defining a note card height, and a pair of joining strips extending between said note card and said front wall, each of said joining strips detachably attached to one of the side edges of said note card at an inner tear line extending along said side edge substantially less than said note card height, and each of said joining strips detachably attached to one of the side borders of the cutout area of said front wall at an outer tear line extending along said side border substantially less than half the height thereof, such that said note card is detachably attached to said front wall by said joining strips.

2. The collapsible gift container of claim 1 wherein:

said front panel has a proximate end and a distal end, said proximate end is hingedly connected to said front wall, and in said container configuration, said distal end is disposed in close adjacency to said rear wall.

3. The collapsible gift container of claim 1 wherein:

each of said inner and outer tear lines comprises a line of perforations.

4. The collapsible gift container of claim 3 wherein:

the top and bottom edges of said note card are die cut, and said cutout area is defined by a bottom border spaced from the bottom edge of said note card.

5. The collapsible gift container of claim 1 wherein:

said note card includes two symmetric halves and a central fold line about which said halves may be folded together.

6. The collapsible gift container of claim 5 wherein:

each half of said note card includes an aperture for use in tying said note card to a gift, and when said halves are folded together the apertures of each said half coincide.

7. A collapsible gift container comprising:

a front wall, a rear wall, and two side walls hingedly connected to said front and rear walls, said front wall having a cutout area defined by opposing vertical side borders and a bottom border, a bottom closure having a front panel hingedly connected to said front wall, a rear panel hingedly connected to said rear wall, and two side panels hingedly connected to said side walls, each of said side panels having a primary area and a bonding area hingedly attached to said primary area, said front panel affixed to the bonding area of one of said side panels, said rear panel affixed to the bonding area of the other of said side panels, said walls and said bottom closure foldable between a flat folded configuration and an open container configuration, in said flat folded configuration, said front wall and one of said side walls are folded into generally parallel adjunct disposition to said rear wall and the other of said side walls, and said bottom closure is sandwiched between said walls with said front panel adjacent said front wall, said rear panel adjacent said rear wall, one of said side panels disposed between said front wall and one of said side walls, and the other of said side panels disposed between said rear wall and the other of said side walls, and in said container configuration said side walls are folded into perpendicular relation to said front and rear walls such said front and rear walls are spaced apart defining a container length and said side walls are spaced apart defining a container width, and said bottom closure is folded into a flat overlapping arrangement wherein said front and rear panels overlay said side panels, said front panel overlays said rear panel, and said front panel extends across substantially the entire length of said container length and across substantially the entire width of said container width, thereby reinforcing said bottom closure, such that said walls and said bottom closure form an open-top container a note card having opposite top and bottom die cut edges and oppositely facing side edges, said top and bottom edges defining a note card height, said bottom edge spaced from the bottom border of the cutout area of said front wall, and a pair of joining strips extending between said note card and said front wall, each of said joining strips detachably attached to one of the side edges of said note card at an inner tear line extending along said side edge substantially less than said note card height, and each of said joining strips detachably attached to one of the side borders of the cutout area of said front wall at an outer tear line extending along said side border substantially less than half the height thereof, such that said note card is detachably attached to said front wall by said joining strips.

* * * * *